United States Patent [19]

Hyland et al.

[11] 4,440,395

[45] Apr. 3, 1984

[54] VARIABLE GEOMETRIC BOARD GAME

[76] Inventors: Joseph F. Hyland, c/o Palm Research, 3298 Casey Key Rd., Nokomis, Fla. 33555; Joseph J. Wetherell, 20 Woodsbridge Rd., Katonah, N.Y. 10536; Mark Setteducati, 107 Clinton St., Emerson, N.J. 07630

[21] Appl. No.: 329,659

[22] Filed: Dec. 11, 1981

[51] Int. Cl.[3] ..... A63F 3/00

[52] U.S. Cl. ..... 273/241; 273/287; 273/284; 273/271; 248/346; 206/487; 206/315.1

[58] Field of Search ..... 273/153 R, 153 S, 241, 273/282, 287; 248/346, 127, 146; 206/486, 487, 488, 489, 490

[56] References Cited

U.S. PATENT DOCUMENTS

| | | | |
|---|---|---|---|
| 3,623,729 | 11/1971 | Wetherell | 273/241 |
| 4,378,117 | 3/1983 | Rubik | 273/153 S |

FOREIGN PATENT DOCUMENTS

| | | | |
|---|---|---|---|
| 1291769 | 3/1962 | France | 273/284 |
| 566157 | 7/1975 | Switzerland | 273/280 |

*Primary Examiner*—Richard C. Pinkham
*Assistant Examiner*—Scott L. Brown
*Attorney, Agent, or Firm*—Natter & Natter

[57] ABSTRACT

A variable geometric board game playable by two or more persons. The game utilizes the six sides of a cube as playing surfaces. The cube is constructed from articulated subcubes that can be rotated about each of three mutually perpendicular axes for changing the playing surfaces. Each of the subcubes has an aperture for receiving marking pegs in accordance with the game rules. The marking pegs are storable in a base unit which interlocks with the subcubes.

11 Claims, 5 Drawing Figures

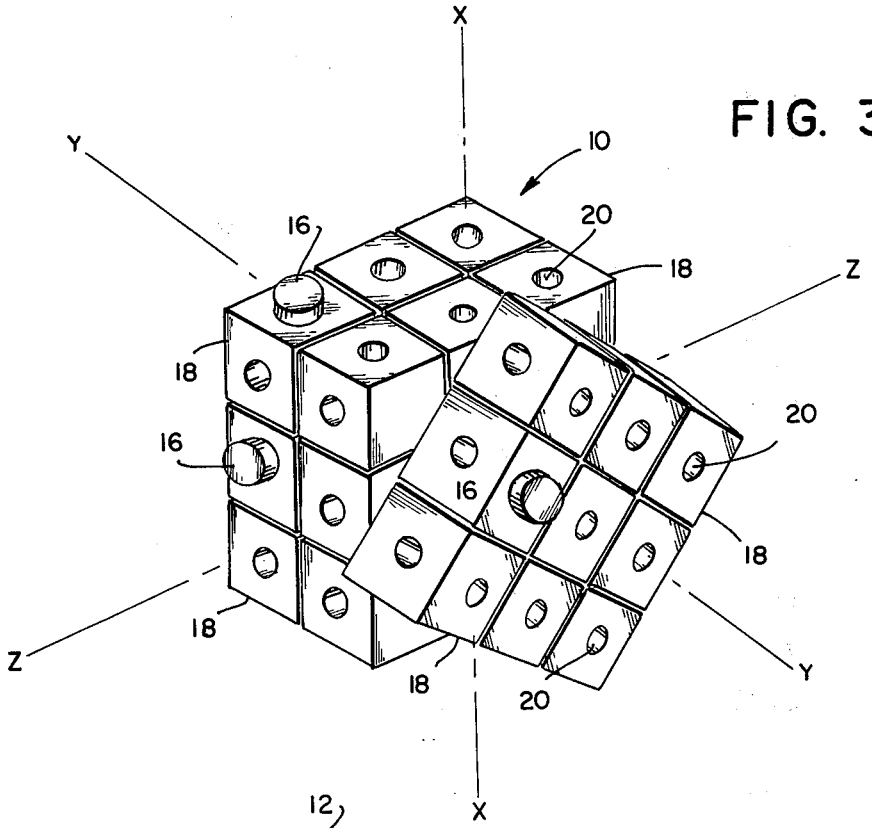
FIG. 3
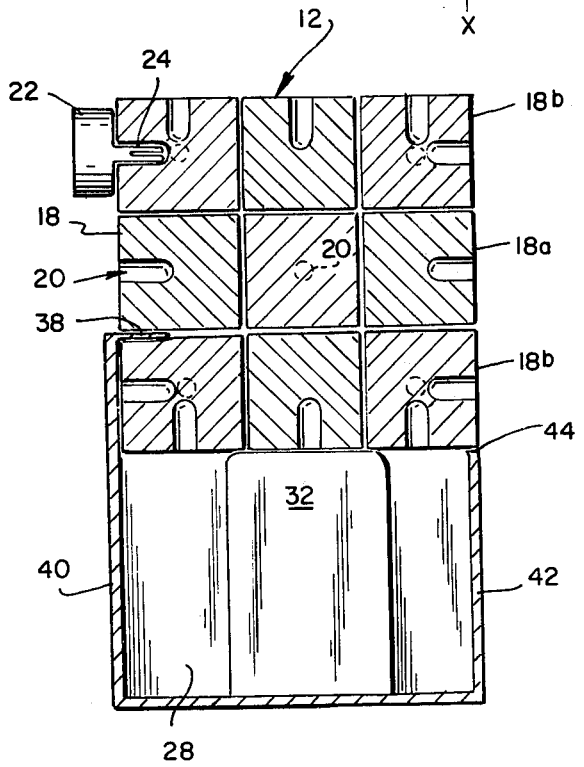
FIG. 4
FIG. 5
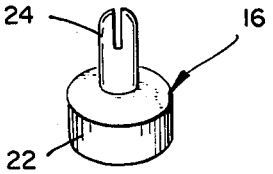

VARIABLE GEOMETRIC BOARD GAME

BACKGROUND OF THE INVENTION

1. Field of the Invention

This invention relates generally to competitive games requiring skill and strategy and especially to a geometric board game.

In particular, the board game of this invention involves changeable playing surfaces lying in different planes and concerns the selective placement of playing pieces on the playing surfaces in a specified pattern.

2. Description of the Prior Art

The board game apparatus of this invention is a second generation development over the cube toy such as described in the Hungarian patent to Erno Rubik (No. 170062) and the Japanese patent publications (Nos. 55-3956, 55-8192 and 55-8193) to Terutoshi Ishige. The structure of similar cube toys was also disclosed in the article entitled Metamagical Themas which appeared in "Scientific American" (March, 1981 at page 20 et seq.). The cube toy of the prior art was primarily directed to a puzzle that required the manipulation of component elements for restoring the cube to its original position. The solution of that puzzle presented a rather formidable logic challenge to the user, however that cube puzzle did not provide a board game contest of skill and strategy for two or more players. Furthermore, many publications have become available offering solutions for restoring the cube to its original position and that consequently diminished the enigma associated with the toy.

The present board game apparatus, in contrast, is not a puzzle but rather an improved peg game for which there is no specific solution. It is intended for use in a competitive game environment. In this connection, it should also be noted that a somewhat similar board game was disclosed in U.S. Pat. No. 3,623,729 to Joseph J. Wetherell, however a shortcoming of that game was that it had only five rectangular playing surfaces and the playing surfaces were not selectively variable as in the instant device.

In addition, the board game of this invention incorporates a complementary base for providing a self-contained portable game apparatus.

SUMMARY OF THE INVENTION

Briefly, the invention is directed to a three dimensional board game apparatus having twenty-seven subcubes forming a geometric body with six planar playing surfaces. The playing surfaces can be varied by rotational displacement of nine contiguous coplanar subcubes about each of three mutually perpendicular axes passing through the center of the geometric body. The exposed face of each subcube lying on each of the six playing surfaces as initially oriented has the same color and each playing surface has a distinctive color.

The apparatus also includes fifty-four playing pieces or marking pegs which are selectively insertable into an aperture provided in the exposed face of each subcube in accordance with the rules of the game.

A companion base unit can be interlocked to the subcubes and provides a storage compartment for the playing pieces.

A feature of this invention relates to the construction of the base unit which includes a locking shelf that snugly fits between two horizontal rows of subcubes. In addition, two walls of the base unit are recessed to form a support shelf for the cube. The base unit can also be employed as a display stand and furnishes a convenient medium for advertising or other indicia.

Having thus summarized the invention, it will be seen that it is an object thereof to provide a variable geometric board game of the general character described herein which is not subject to the aforementioned disadvantages.

Specifically, it is an object of this invention to provide a geometric board game utilizing a cube comprised of a plurality of internally interconnected articulated subcubes.

A further object of this invention is to provide a geometric board game wherein the exposed surfaces of the subcubes are provided with apertures that are adapted to receive marking pegs.

An additional object of the present invention is to provide a geometric board game including a base unit which can be coupled to the subcubes.

A still further object of this invention is to provide a geometric board game which is simple in construction, low in cost, reliable in use and well adapted for mass production fabrication techniques.

Other objects of the invention in part will be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention:

FIG. 3 is a perspective view of the geometric board game in use showing several marking pegs affixed to respective subcubes, with nine contiguous coplanar subcubes rotated 45 degrees;

FIG. 4 is a sectional view taken substantially along line 4—4 of FIG. 1, showing the interlocking structure of the base unit as well as the cube support structure and the peg receiving apertures; and FIG. 5 is a perspective view of the marking peg.

DESCRIPTION OF THE PREFERRED EMBODIMENT

Figure 1:
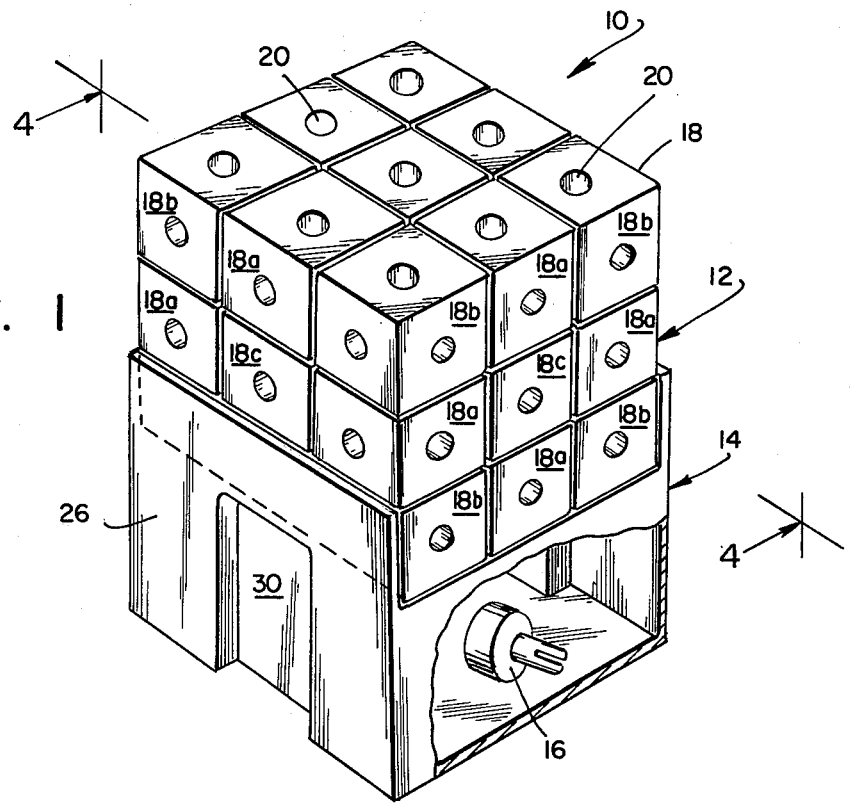
FIG. 1 is a perspective view of a geometric board game of this invention showing a cube comprised of subcubes and a base unit interlocked to the subcubes, with a portion of the base unit broken away to expose a typical playing piece stored therein.

Referring now in detail to the drawings, the reference numeral 10 denotes generally a variable geometric board game apparatus of this invention. The board game 10, as typically illustrated in FIG. 1, includes a six sided cube 12 and a base unit 14 which provides storage for a plurality of playing pieces 16. It should be further observed that the base unit 14 can also function as a display stand for the board game 10, and for that purpose advertising or other indicia may be placed thereon.

The cube 12 is comprised of individual components in the form of articulated subcubes 18 which are affixed to a spindle (not shown) and internally interlocked such as in the construction shown in the Rubik patent (supra) or in the publication "Scientific American" (supra, at page 25). It should be apparent that equivalent structural arrangements can be used which provide rotatability about three mutually perpendicular imaginary axes X—X, Y—Y and Z—Z, extending through the center of cube 12 as noted in FIG. 3.

In the preferred embodiment, there are twenty-seven subcubes 18 which can be molded in polyethylene, ABS, polycarbonate or other suitable plastic material. The array of subcubes 18 in the exemplary embodiment illustrated includes twelve edge subcubes 18*a*, eight corner subcubes 18*b* and six center subcubes 18*c*.

Figure 2:
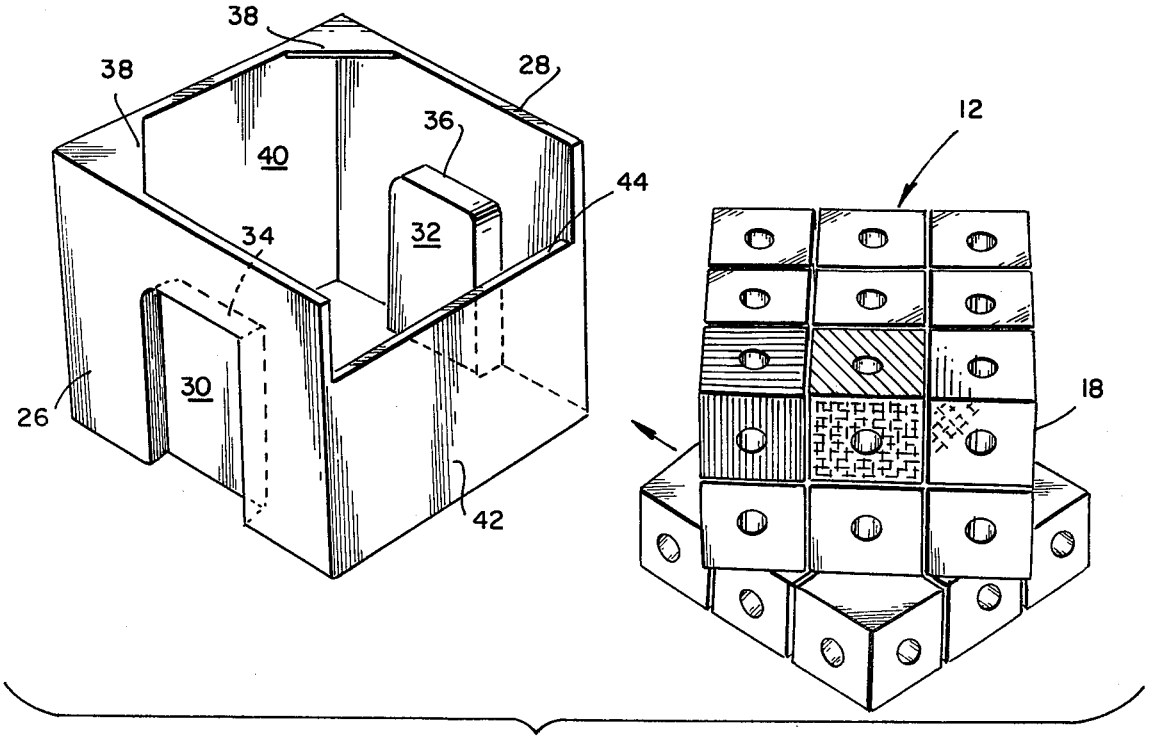
FIG. 2 is a perspective view of the geometric board game separated from the base unit and illustrating how these two components interfit.

The manipulation of the subcubes 18 is in conformity with the cube toy of the prior art in that any nine contiguous coplanar subcubes 18 lying within the same horizontal or vertical plane can be independently rotated 0–360 degrees as typically shown in FIGS. 2 and 3. Furthermore, the exposed faces of each group of nine co-planar subcubes 18 are of the same color such that each of the six sides of the cube 12 will in its initial position have the six different colors and by turning of the subcubes 18 a mosaic will be formed of different color subcube faces.

In addition, each of the subcubes 18 is provided with a centrally located aperture 20 extending normal to its exposed face. In this regard, it should be noted that the edge subcube 18*a* will have an aperture 20 in each of its two exposed faces. The corner subcubes 18*b* which have three apertures 20 in each of its three faces and the center subcubes 18*c* each have a single aperture 20. The apertures 20 can be molded during fabrication of the subcubes 18 or otherwise provided therein.

The playing pieces 16 are preferably in the form of transparent plastic marking pegs and each includes a head 22 and a bifurcated stem 24. The bifurcated stem 24 is resiliently yieldable for providing a snug fit within a selected receiving aperture 20. Alternatively, instead of this peg arrangement, magnetized playing pieces can be employed with a co-active material placed on the subcubes 18.

The base unit 14 consists primarily of a substantially rectangular five sided enclosure with an open top. Two of the side walls 26, 28 of the base unit 14 are provided with a recessed segment 30, 32, respectively, each having a support ledge 34, 36. A triangular corner substantially horizontal locking shelf 38 projects inwardly from a rear wall 40; the forward wall 42 of the base unit 14 is provided with a notched opening having a lower edge 44 which is substantially coplanar with the ledge 34, 36.

It should be apparent from FIG. 2 that the cube 12 is adapted to be slidingly received (as indicated by the arrow) and correspondingly disengaged from the base unit 14. For this purpose, the lower horizontal array of subcubes 18 is supported on the ledge 34, 36 and the locking shelf 38 is insertable between the lower and middle horizontal array of subcubes 18. In order to facilitate the locking action of the locking shelf 38, the lower array of subcubes 18 is partially rotated through a 45 degree displacement and then returned to its original position whereby the middle array of subcubes 18 overlaps the locking shelf 38 and will assume the position shown in FIG. 1. It should be noted that the vertical displacement between the locking shelf 38 and ledge 34, 36 can be one or more multiples of the subcube dimension.

The board game 10 of this invention can be played by two players, three players or four players. The game is begun by shuffling or scrambling the subcubes 18 through rotational manipulation in a manner such that the six colors on the exposed faces of the subcubes 18 are thoroughly mixed on each of the playing surfaces of the cube 12. Each player then selects an identifying color or colors corresponding to that on the exposed face of a subcube 18. If there are two players, each player selects three colors; if there are three players, each player selects two colors; and if there are four players, each player selects one color, with the remaining two colors not being used. The players, in turn, affix one of the fifty-four transparent playing pieces 16 to any selected subcube 18 bearing his designated color and then rotates that subcube 90 degrees in any direction of rotation. The object of the game is to be the first player to have playing pieces 16 on three consecutive subcube faces in one of the designated colors and lying on one of the six playing surfaces of cube 12 in either a vertical, horizontal or diagonal line in a manner similar to the game of tic-tac-toe.

The strategy involved in the game is both to accomplish the individual player's goal and at the same time to block his opponent.

A modified version of the board game rules utilizes the same cube apparatus except that the six center subcubes 18*c* do not have apertures 20. In addition, forty-eight playing pieces, rather than fifty-four, are used with eight each in six different colors. Each player then chooses eight playing pieces of one color. The first player places a playing piece on any one of the four edge subcubes 18*a* on the surface of the cube in which the corresponding playing piece color also appears on the center subcube 18*c*. The first player's initial move cannot be to place a playing piece on a corner subcube 18*b*. After the first move is made, any player can place a playing piece on any subcube on the six playing surfaces of the cube wherein his corresponding color appears on the center subcube 18*c*. After each player places his playing piece on a subcube, he then turns any two arrays of nine contiguous subcubes 90 degrees or moves the same array 180 degrees in any direction. The play continues in this manner until one player creates a line of three consecutive playing pieces on the surface of the cube having a center subcube 18*c* which bears the color corresponding to the color of the playing pieces.

Thus, it will be seen that there is provided a variable geometric board game apparatus which achieves the various objects of the invention and which is well adapted to meet the conditions of practical use.

Since various possible embodiments might be made of the present invention and various changes might be made in the examplary embodiments set forth, it is to be understood that all material set forth as shown in the accompanying drawings should be interpreted as illustrative and not in a limiting sense.

Having thus described the invention, there is claimed as new and desired to be secured by Letters Patent:

1. A variable geometric board game apparatus providing a competitive game of skill and strategy for two or more players comprising a cube with each of its six sides being color coded, said cube further being formed of interconnected articulated subcubes, a plurality of companion playing pieces, said playing pieces being attachable to selected subcubes, said subcubes being rotationally displaceable about each of three mutually perpendicular axes passing through the center of the cube for achieving an arrangement of playing pieces on consecutive subcubes bearing the same color and lying on one face of the cube.

2. A variable geometric board game apparatus as claimed in claim 1 further including a base unit, said base unit being securable to the subcubes and enclosure means within said base unit for storing said playing pieces.

3. A variable geometric board game apparatus as claimed in claim 2 wherein the base unit includes two parallel upstanding wall sections, with at least one wall section including ledge means for supporting the cube.

4. A variable geometric board game apparatus as claimed in claim 3 further including locking shelf means interfitting with the subcubes for securing the subcubes to the base unit.

5. A variable geometric board game apparatus as claimed in claim 4 wherein the vertical displacement between the ledge means and locking shelf means is equivalent to one or more multiples of the subcube dimension.

6. A variable geometric board game apparatus as claimed in claim 5 wherein a forward wall of the base unit is provided with a notched opening for receiving the cube.

7. A variable geometric board game apparatus as claimed in claim 6 wherein the lower edge of the notched opening and the support ledge are substantially coplanar whereby the cube can be slid into the base unit with the subcubes located above the locking shelf rotationally displaced and reorientation of the displaced subcubes to their initial positions overlying the locking shelf secures the cube to the base unit.

8. A variable geometric board game apparatus as claimed in claim 1 wherein each of the exposed faces of the subcube has at least one aperture, said aperture being adapted for accommodating a playing piece.

9. A variable geometric board game apparatus as claimed in claim 8 wherein the aperture extends substantially normal to the face of the subcube.

10. A variable geometric board game apparatus as claimed in claim 1 wherein the playing piece is comprised of a marking peg, said peg having a head portion and a stem portion, said stem portion being receivable in said aperture with said head portion being held to the exposed face of the respective subcube.

11. A variable geometric board game apparatus as claimed in claim 10 wherein the stem portion of said peg is flexibly resilient for snug accommodation in said aperture.

* * * * *